US008281596B1

(12) United States Patent
Rohrssen et al.

(10) Patent No.: US 8,281,596 B1
(45) Date of Patent: Oct. 9, 2012

(54) COMBUSTOR ASSEMBLY FOR A TURBOMACHINE

(75) Inventors: Robert Joseph Rohrssen, Simpsonville, SC (US); Erich Daniel Charters, Taylors, SC (US); Abdul Rafey Khan, Greenville, SC (US); Patrick Benedict Melton, Horse Shoe, NC (US); John Drake Vanselow, Taylors, SC (US)

(73) Assignee: General Electric Company, Schenectady, NY (US)

( * ) Notice: Subject to any disclaimer, the term of this patent is extended or adjusted under 35 U.S.C. 154(b) by 22 days.

(21) Appl. No.: 13/108,164

(22) Filed: May 16, 2011

(51) Int. Cl.
*F23R 3/14* (2006.01)
*F02C 3/14* (2006.01)

(52) U.S. Cl. ..... 60/747; 60/760; 60/737

(58) Field of Classification Search ..... 60/748, 60/746, 737, 747, 739, 752, 760
See application file for complete search history.

(56) References Cited

U.S. PATENT DOCUMENTS

| | | | | |
|---|---|---|---|---|
| 3,643,426 | A | 2/1972 | Janelid | |
| 4,786,016 | A | 11/1988 | Presz, Jr. et al. | |
| 4,844,689 | A | 7/1989 | Seed | |
| 5,274,991 | A | 1/1994 | Fitts | |
| 5,406,786 | A | 4/1995 | Scharpf et al. | |
| 6,209,325 | B1 * | 4/2001 | Alkabie | 60/737 |
| 6,345,493 | B1 | 2/2002 | Smith et al. | |
| 6,435,814 | B1 | 8/2002 | Yu et al. | |
| 6,438,961 | B2 | 8/2002 | Tuthill et al. | |
| 6,442,941 | B1 | 9/2002 | Anand et al. | |
| 6,484,505 | B1 | 11/2002 | Brown et al. | |
| 6,543,234 | B2 | 4/2003 | Anand et al. | |
| 6,554,562 | B2 | 4/2003 | Dudebout et al. | |
| 6,584,779 | B2 | 7/2003 | Priestley | |
| 6,598,398 | B2 | 7/2003 | Viteri et al. | |
| 6,626,635 | B1 | 9/2003 | Prowse | |
| 6,824,710 | B2 | 11/2004 | Viteri et al. | |
| 6,899,081 | B2 | 5/2005 | Bielicki et al. | |
| 6,910,335 | B2 | 6/2005 | Viteri et al. | |
| 6,935,116 | B2 * | 8/2005 | Stuttaford et al. | 60/737 |
| 6,958,383 | B2 | 10/2005 | Desmazeau et al. | |
| D511,377 | S | 11/2005 | Erwan et al. | |
| 7,007,478 | B2 | 3/2006 | Dinu | |
| 7,340,129 | B2 | 3/2008 | Yalin et al. | |
| 7,412,129 | B2 | 8/2008 | Yalin et al. | |
| 7,420,662 | B2 | 9/2008 | Yalin et al. | |
| 7,654,320 | B2 | 2/2010 | Payton | |
| 7,762,074 | B2 | 7/2010 | Bland et al. | |
| 2009/0223228 | A1 | 9/2009 | Romoser | |
| 2010/0326082 | A1 | 12/2010 | Ziminsky et al. | |

* cited by examiner

*Primary Examiner* — Ted Kim
(74) *Attorney, Agent, or Firm* — Cantor Colburn LLP

(57) ABSTRACT

A combustor assembly for a turbomachine includes combustor housing and a flow sleeve arranged between the combustor housing and a combustor liner. The flow sleeve defines a first annular fluid passage, and a second annular fluid passage. A quaternary cap is mounted to the combustor housing. The quaternary cap includes a first fluid plenum fluidly connected to the first annular fluid passage, a second fluid plenum fluidly connected to the second annular fluid passage, and a plurality of vanes fluidly connected to each of the first and second fluid plenums. Each of the plurality of vanes includes a body portion having a first fluid channel coupled to the first fluid plenum, and a second fluid channel coupled to the second fluid plenum. The first fluid channel extends completely through the body portion and the second fluid channel extends partially into the body portion.

20 Claims, 4 Drawing Sheets

COMBUSTOR ASSEMBLY FOR A TURBOMACHINE

BACKGROUND OF THE INVENTION

The subject matter disclosed herein relates to the art of turbomachines and, more particularly, to a combustor assembly for a turbomachine.

In conventional turbomachines, a first fluid, such as fuel, is directed into a combustor casing prior to being mixed with another fluid, such as air, and combusted to form hot gases. The first fluid enters the combustor casing through a fuel manifold. The fuel manifold extends about, and is joined to, the combustor casing. The fuel manifold is generally formed by joining three strips of material to form an inverted U-shaped structure having one open end. The open end is then placed over fuel inlets provided in the combustor casing. At this point, the fuel manifold is joined to the combustor casing by welding. Fluid is then introduced into the fuel manifold and directed into the combustor casing via the fuel inlets. Compressor discharge air is fed through feed holes formed in a cap coupled to the combustor casing. The compressor discharge air mixes with the fuel flowing from the fuel manifold to form a combustible mixture that is directed through an injector and combusted to form the hot gases.

BRIEF DESCRIPTION OF THE INVENTION

According to one aspect of the exemplary embodiment, a combustor assembly for a turbomachine includes a combustor housing having a first end, and a combustor body arranged within the combustor housing. The combustor body defines a combustor liner having a first end portion that extends to a second end portion through a combustion chamber. A flow sleeve extends about the combustion chamber. The flow sleeve is arranged between the combustor housing and the combustor liner. The flow sleeve defines a first annular fluid passage, and a second annular fluid passage. A quaternary cap is mounted to the first end of the combustor housing. The quaternary cap includes a first fluid plenum fluidly connected to the first annular fluid passage, a second fluid plenum fluidly connected to the second annular fluid passage, and a plurality of vanes fluidly connected to each of the first and second fluid plenums. Each of the plurality of vanes includes a body portion having a first fluid channel coupled to the first fluid plenum, and a second fluid channel coupled to the second fluid plenum. The first fluid channel extends completely through the body portion and the second fluid channel extends partially into the body portion. An end cover assembly is operatively connected to the combustor body through the quaternary cap. The end cover assembly includes a plurality of fuel Nozzles fluidly connected to the second annular fluid passage. The plurality of fuel Nozzles extends toward the combustion chamber.

According to another aspect of the exemplary embodiment, a turbomachine includes a compressor portion including a compressor discharge, a turbine portion operatively connected to the compressor portion, and a combustor assembly fluidly connected to the compressor portion and the turbine portion. The combustor assembly includes a combustor housing having a first end, and a combustor body arranged within the combustor housing. The combustor body defines a combustor liner having a first end portion that extends to a second end portion through a combustion chamber. A flow sleeve extends about the combustion chamber. The flow sleeve is arranged between the combustor housing and the combustor liner. The flow sleeve defines a first annular fluid passage fluidly connected between the compressor discharge and the combustion chamber, and a second annular fluid passage fluidly connected to the compressor discharge. A quaternary cap is mounted to the first end of the combustor housing. The quaternary cap includes a first fluid plenum fluidly connected to the first annular fluid passage, a second fluid plenum fluidly connected to the second annular fluid passage, and a plurality of vanes fluidly connected to each of the first and second fluid plenums. Each of the plurality of vanes includes a body portion having a first fluid channel coupled to the first fluid plenum, and a second fluid channel coupled to the second fluid plenum. The first fluid channel extends completely through the body portion and the second fluid channel extends partially into the body portion. An end cover assembly is operatively connected to the combustor body through the quaternary cap. The end cover assembly includes a plurality of fuel Nozzles fluidly connected to the second annular fluid passage. The plurality of fuel nozzles extends toward the combustion chamber.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
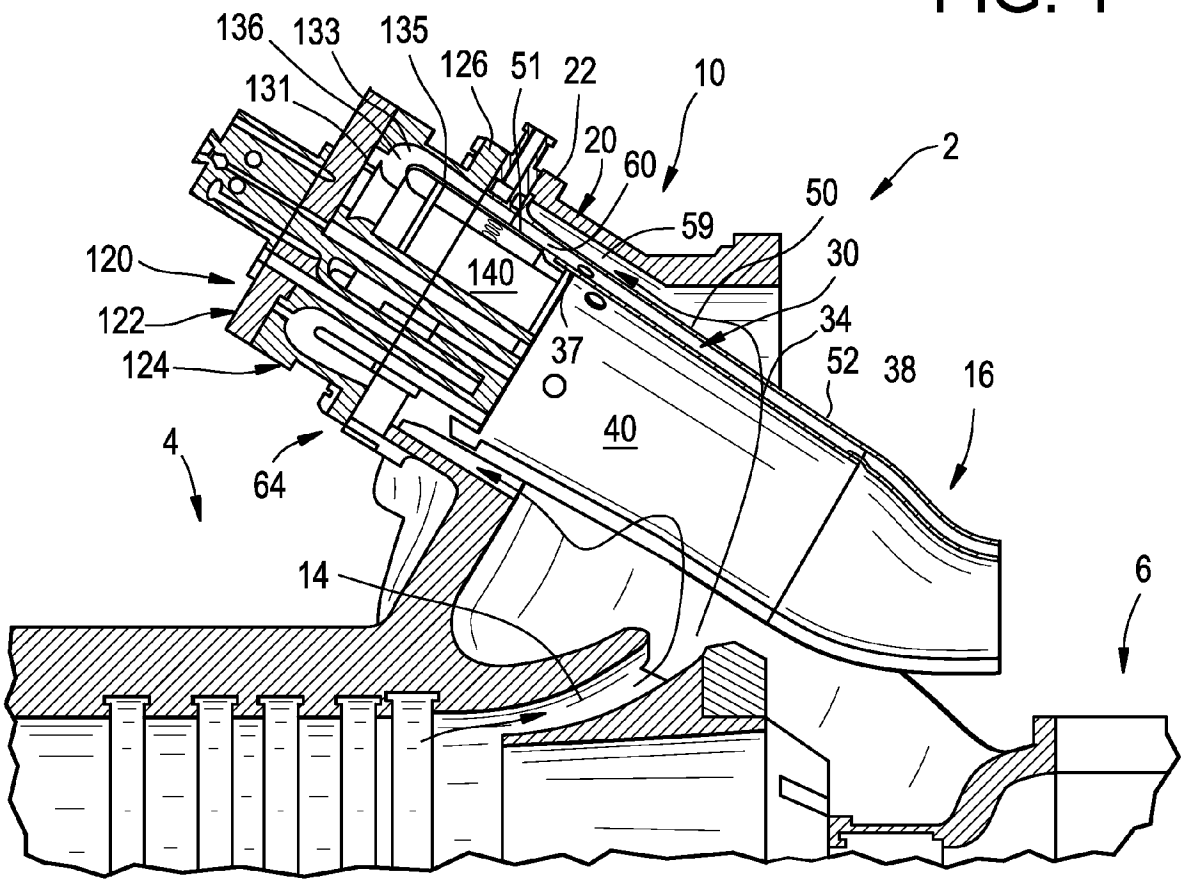
FIG. 1 is a partial, cross-sectional side view of a turbomachine including a combustor assembly in accordance with an exemplary embodiment.

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a combustor assembly. The terms "radial" and "radially" as used in this application refer to directions and orientations extending substantially orthogonally to the center longitudinal axis of the combustor assembly. The terms "upstream" and "downstream" as used in this application refer to directions and orientations relative to an axial flow direction with respect to the center longitudinal axis of the combustor assembly.

With reference to FIGS. 1-4, a turbomachine in accordance with an exemplary embodiment is indicated generally at 2. Turbomachine 2 includes a compressor portion 4 operatively connected to a turbine portion 6. A combustor assembly 10 fluidly connects compressor portion 4 with turbine portion 6. Compressor portion 4 includes a compressor discharge 14 that passes compressor discharge air into combustor assembly 10. As will be discussed more fully below, one portion of the combustor discharge air is employed for cooling various components of combustor assembly 10, and another portion of the compressor discharge air is mixed with fuel to form a combustible mixture that is combusted to form hot gases. The hot gases pass from combustor assembly 10 through a transition piece 16 into turbine portion 6. Turbine portion 6 converts thermal energy from the hot gases into mechanical, rotational energy used to power various systems such as generators, pumps and the like (not shown).

Figure 2:
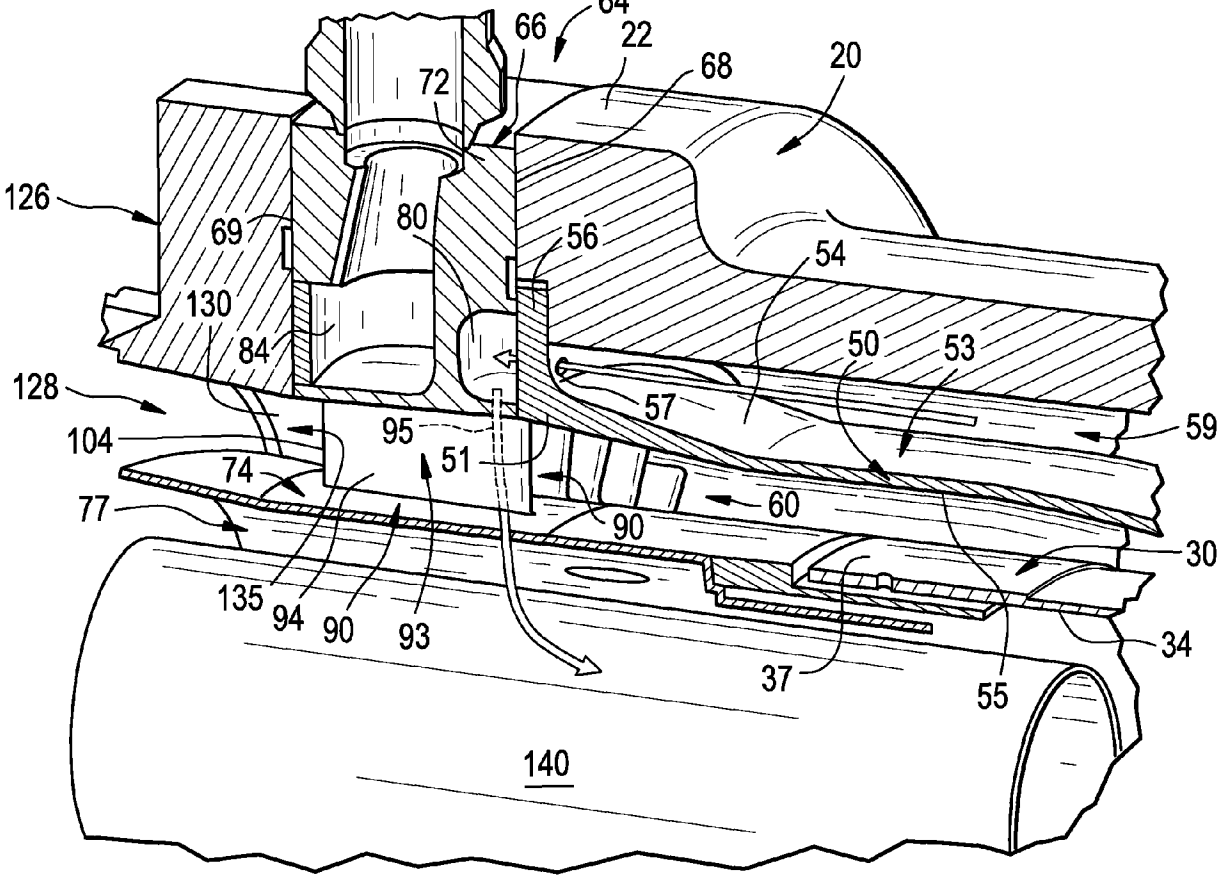
FIG. 2 is a partial perspective view of the combustor assembly of FIG. 1 illustrating fluid flow through a first annular fluid flow passage into a first plenum of a quaternary cap in accordance with the exemplary embodiment.
Figure 3:
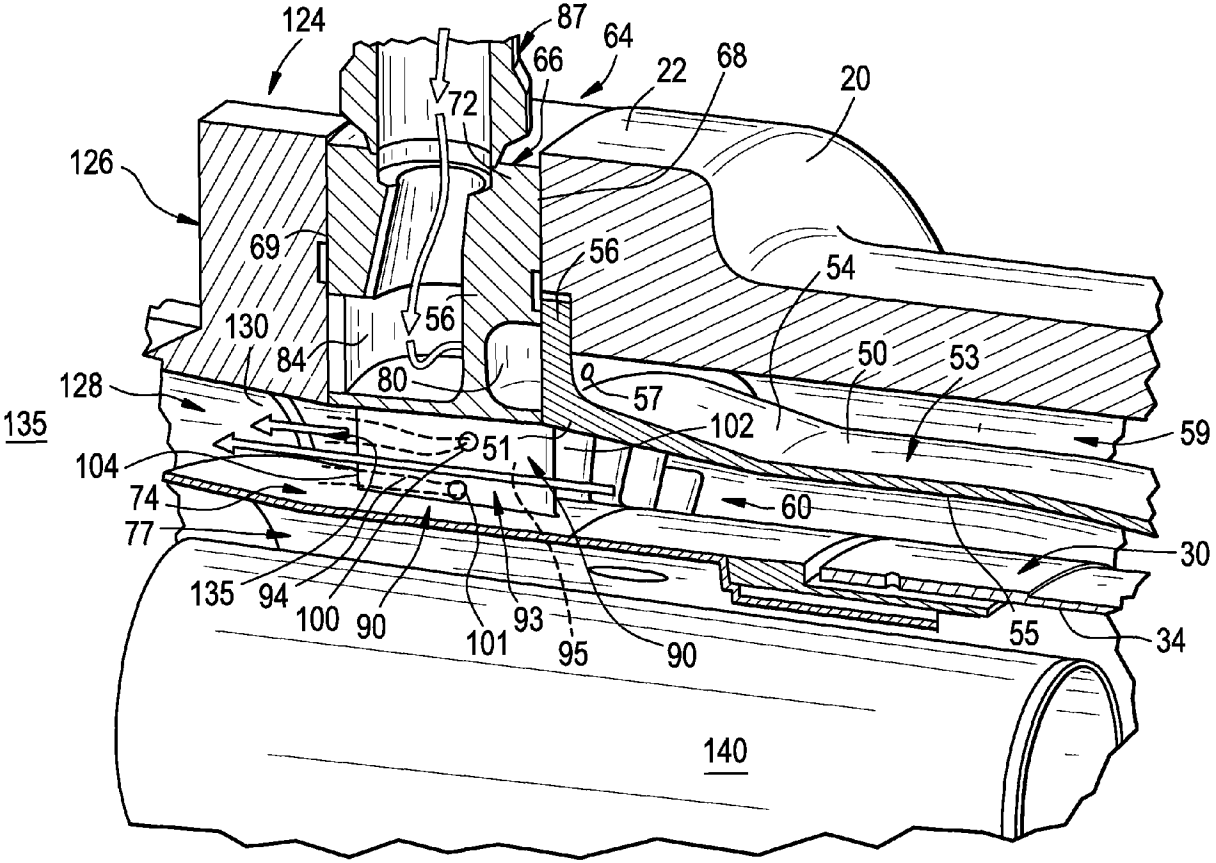
FIG. 3 is a partial perspective view of the combustor assembly of FIG. 1 illustrating fluid flow passing into a second plenum of a quaternary cap of FIG. 2.
Figure 4:
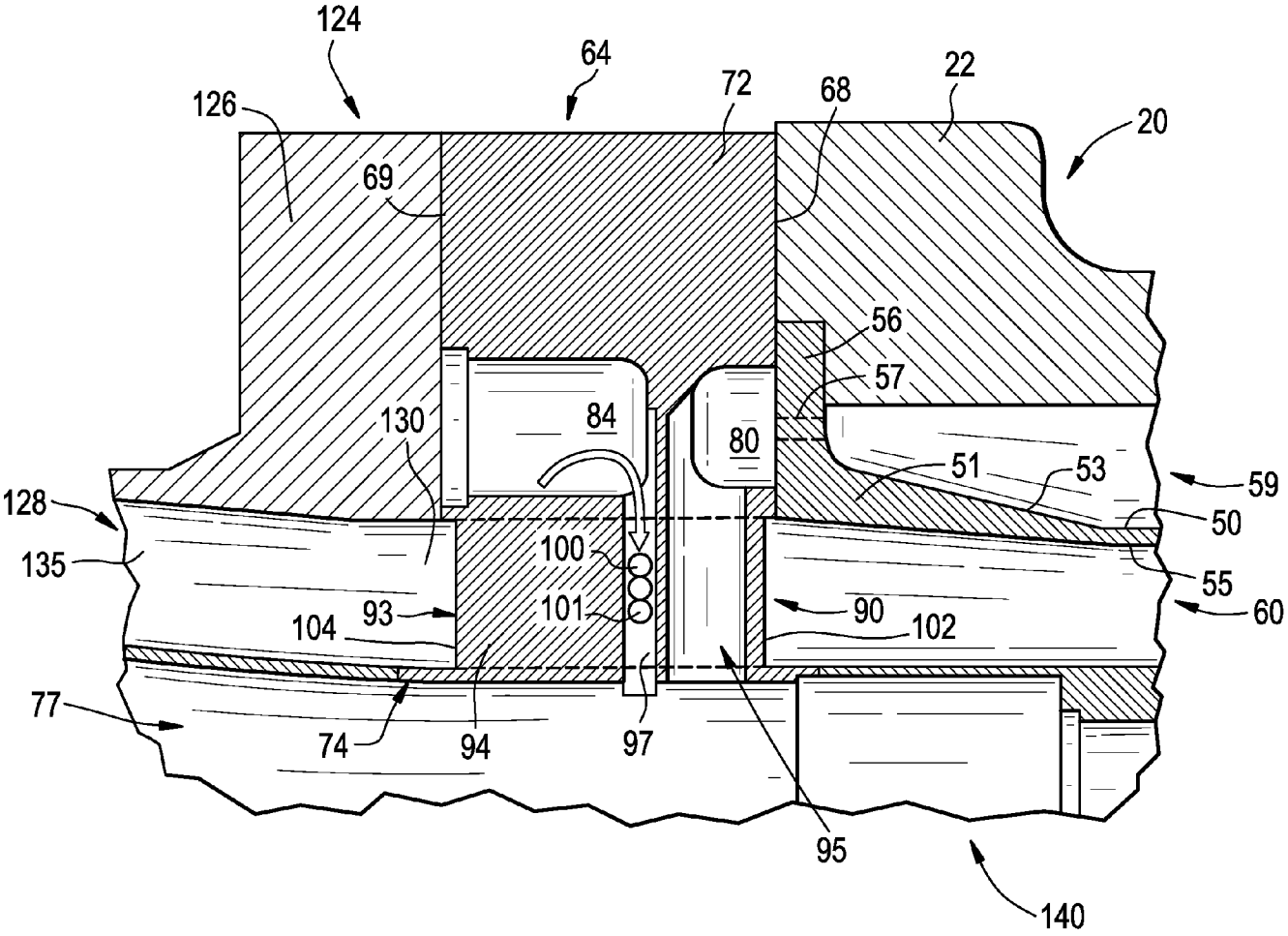
FIG. 4 is a cross-sectional detail view of the quaternary cap of FIG. 2.

In accordance with the exemplary embodiment shown, combustor assembly 10 includes a combustor housing 20 having a first end 22 that extends to a second end (not shown). Combustor assembly 10 includes a combustor body 30 arranged within combustor housing 20. Combustor body 30 defines a combustor liner 34. Combustor liner 34 includes a first end portion 37 that extends to a second end portion 38 through a combustion chamber 40. A flow sleeve 50 extends about combustor body 30. As will be discussed more fully below, flow sleeve 50 is spaced from combustor housing 20 and combustor body 30. Flow sleeve 50 includes a first end section 51 that is arranged proximate to first end 22 of combustor housing 20. First end section 51 extends to a second end section 52 through an intermediate section 53. Intermediate section 53 includes a first surface 54 and an opposing second surface 55. Flow sleeve 50 is also shown to include a flange 56 at first end section 51. Flange 56 includes a plurality of fluid openings one of which is shown at 57. As best shown in FIGS. 2 and 3, flow sleeve 51 defines a first annular fluid passage 59 between first surface 54 and combustor housing 20 and a second annular fluid passage 60 between second surface 55 and combustor liner 34. First and second annular flow passages 59 and 60 deliver compressor discharge air from compressor discharge 14 to a quaternary cap 64 as will be discussed more fully below.

Quaternary cap 64 includes an annular body 66 which, in accordance with one aspect of the exemplary embodiment, is formed from a corrosion resistant material such as stainless steel. Quaternary cap 64 includes a first surface 68 abutting to combustor body 30 and a second, opposing surface 69. Body 66 includes a first or outer body portion 72 and a second or inner body portion 74 that defines a combustor passage 77. Outer body portion 72 includes a first fluid plenum 80 fluidly connected to first annular fluid passage 59 via fluid openings 57, and a second fluid plenum 84 fluidly connected to second annular fluid passage 60. Second fluid plenum 84 is fluidly connected to an inlet member 87 though which a first fluid, generally a quaternary fuel, is introduced into quaternary cap 64. First and second fluid plenums 80 and 84 are also fluidly connected to a plurality of vanes, one of which is indicated at 90 that interconnect outer body portion 72 and inner body portion 74.

In accordance with the exemplary embodiment each of the plurality of vanes 90 include a body portion 93 that defines an airfoil 94. Vanes 90 include a first fluid channel 95 that extends completely through body portion 93, and a second fluid channel 97 that extends partially through body portion 93. First fluid channel 95 is fluidly connected to first fluid plenum 80 and second fluid channel 97 is fluidly connected to second fluid plenum 84.

With this arrangement, a first portion of compressor discharge air flows axially through first annular fluid passage 59, passes through fluid openings 57 into first fluid plenum 80 before entering first fluid channel 95. The first portion of compressor discharge air provides cooling to portions of quaternary cap 64 prior to entering into combustion chamber 40 to mix with hot gases as will be discussed more fully below. Another fluid, typically fuel, flow into inlet member 87 and enters second fluid plenum 84. The fuel passes radially into second fluid channel 97 and passes from body portion 93 of vane 90 through a plurality of fluid discharge openings 100 and 101. Fluid discharge openings, two of which are indicated at 100 and 101 extend radially along body portion 93 of vane 90. A second portion of compressor discharge air passes through second annular fluid passage 60 toward quaternary cap 64. The second portion of compressor discharge air passes over an upstream end 102 of the plurality of vanes 90. The second portion of compressor discharge air passes across airfoil 94 mixes with the fuel and flows toward a downstream end 104 of vanes 90 forming a combustible air-fuel mixture. The combustible air-fuel mixture flows into an end cover assembly 120 as will be detailed more fully below.

End cover assembly 120 includes an end cover 122 and a forward casing 124. Forward casing 124 includes a flange 126 that is operatively connected to second surface 69 of quaternary cap 64 through a plurality of bolts (not separately labeled). Forward casing 124 is also shown to include a fluid passageway 128 that is fluidly connected to second annular fluid passage 60. Fluid passageway 128 includes a first end 130 that extends from quaternary cap 64 to a second end 131 through an intermediate portion 133. Intermediate portion 133 includes a first or substantially liner section 135 and a second or curvilinear section 136. The combustible mixture flows through fluid passageway 128 and flows into a plurality of fuel nozzles, one of which is indicated at 140, supported by end cover 120. Fuel nozzles 140 extends from end cover 120, through combustor passage 77 and toward combustion chamber 40. The combustible mixture passes into fuel nozzles 140, and is combusted forming hot gases that expand through combustion chamber 40 and flow through transition piece 16 into turbine portion 6.

The exemplary embodiment provides an apparatus for facilitating mixing of a quaternary fuel and air prior to introduction into a fuel nozzle. The plurality of vanes includes airfoil surfaces that reduce flow disturbances and reduce flame holding in an second annular flow passage. The distance between the fuel introduction at the vanes and the combustion chamber is enhanced so as to achieve a desired mixing of air and fuel prior to combustion. In addition, the exemplary embodiment includes a flow sleeve that provides for a more even distribution of air into the quaternary cap while also providing cooling air that flows through a region spaced from the combustion chamber. Finally, the use of aerodynamic vanes, not only enhances mixing, and provides distinct passages for cooling air and fuel. The use of quat fuel injection provided enhanced control of combustion dynamics by staging injection and allowing the fuel nozzles to operate with lower fuel pressure ratios. That is, less fuel is being forced through the injection holes in the fuel nozzles thereby leading to a "softer" acoustical response and, by extension the turbomachine is less susceptible to a feedback loop (i.e. combustion dynamics).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor assembly for a turbomachine, the combustor assembly comprising:

a combustor housing having a first end;

a combustor body arranged within the combustor housing, the combustor body defining a combustor liner having a first end portion that extends to a second end portion through a combustion chamber;

a flow sleeve extending about the combustion chamber, the flow sleeve being arranged between the combustor housing and the combustor liner, the flow sleeve defining a first annular fluid passage and a second annular fluid passage;

a quaternary cap mounted to the first end of the combustor housing, the quaternary cap including a first fluid plenum fluidly connected to the first annular fluid passage, a second fluid plenum fluidly connected to the second annular fluid passage, and a plurality of vanes fluidly connected to each of the first and second fluid plenums, each of the plurality of vanes including a body portion having a first fluid channel coupled to the first fluid plenum, and a second fluid channel coupled to the second fluid plenum, the first fluid channel extending completely through the body portion and the second fluid channel extending partially into the body portion; and an end cover and casing assembly operatively connected to the combustor body through the quaternary cap, the end cover assembly including a plurality of fuel nozzles fluidly connected to the second annular fluid passage, the plurality of fuel nozzles extending toward the combustion chamber.

2. The combustor assembly according to claim 1, wherein each of the plurality of vanes includes a plurality of fluid discharge openings arranged in the body portion and fluidly connected between the second fluid channel and the second annular fluid passage.

3. The combustor assembly according to claim 2, wherein the plurality of fluid discharge openings extends radially along the body portion of each of the plurality of vanes.

4. The combustor assembly according to claim 1, wherein each of the plurality of vanes include a downstream end and an upstream end, the upstream end being exposed to the second annular fluid passage.

5. The combustor assembly according to claim 4, wherein the end cover assembly includes a fluid passageway that extends from the downstream end of each of the plurality of vanes to the plurality of fuel nozzles.

6. The combustor assembly according to claim 1, wherein the body portion of each of the plurality of vanes comprise an airfoil.

7. The combustor assembly according to claim 1, wherein the quaternary cap is formed from a corrosion resistant material.

8. The combustor assembly according to claim 1, wherein the quaternary cap includes an inlet member fluidly connected to the second fluid plenum.

9. The combustor assembly according to claim 1, wherein the flow sleeve includes a first end section, a second end section, and a flange that extends radially from the first end section, the flange abutting the quaternary cap.

10. The combustor assembly according to claim 9, wherein the flange includes a plurality of openings fluidly connecting the first annular fluid passage to the first fluid plenum.

11. A turbomachine comprising:

a compressor portion including a compressor discharge;

a turbine portion operatively connected to the compressor portion; and a combustor assembly fluidly connected to the compressor portion and the turbine portion, the combustor assembly comprising:

a combustor housing having a first end;

a combustor body arranged within the combustor housing, the combustor body defining a combustor liner having a first end portion that extends to a second end portion through a combustion chamber;

a flow sleeve extending about the combustion chamber, the flow sleeve being arranged between the combustor housing and the combustor liner, the flow sleeve defining a first annular fluid passage fluidly connected between the compressor discharge and the combustion chamber, and a second annular fluid passage fluidly connected to the compressor discharge;

a quaternary cap mounted to the first end of the combustor housing, the quaternary cap including a first fluid plenum fluidly connected to the first annular fluid passage, a second fluid plenum fluidly connected to the second annular fluid passage, and a plurality of vanes fluidly connected to each of the first and second fluid plenums, each of the plurality of vanes including a body portion having a first fluid channel coupled to the first fluid plenum, and a second fluid channel coupled to the second fluid plenum, the first fluid channel extending completely through the body portion and the second fluid channel extending partially into the body portion; and an end cover assembly operatively connected to the combustor body through the quaternary cap, the end cover assembly including a plurality of fuel nozzles fluidly connected to the second annular fluid passage, the plurality of fuel nozzles extending toward the combustion chamber.

12. The turbomachine according to claim 11, wherein each of the plurality of vanes includes a plurality of fluid discharge openings arranged in the body portion and fluidly connected between the second fluid channel and the second annular fluid passage.

13. The turbomachine according to claim 12, wherein the plurality of fluid discharge openings extends radially along the body portion of each of the plurality of vanes.

14. The turbomachine according to claim 11, wherein each of the plurality of vanes includes a downstream end and an upstream end, the upstream end being exposed to the second annular fluid passage.

15. The turbomachine according to claim 14, wherein the end cover assembly includes a fluid passageway that extends from the downstream end of each of the plurality of vanes to the plurality of fuel nozzles.

16. The turbomachine according to claim 11, wherein the body portion of each of the plurality of vanes comprise an airfoil.

17. The turbomachine according to claim 11, wherein the quaternary cap is formed from a corrosion resistant material.

18. The turbomachine according to claim 11, wherein the quaternary cap includes an inlet member fluidly connected to the second fluid plenum.

19. The turbomachine according to claim 11, wherein the flow sleeve includes a first end section, a second end section, and a flange that extends radially from the first end section, the flange abutting the quaternary cap.

20. The turbomachine according to claim 19, wherein the flange includes a plurality of openings fluidly connecting the first annular fluid passage to the first fluid plenum.

* * * * *